US007118111B1

(12) United States Patent
Altomare

(10) Patent No.: US 7,118,111 B1
(45) Date of Patent: Oct. 10, 2006

(54) METHOD FOR PLAYING A CASINO CARD GAME

(76) Inventor: Rick Altomare, 37921 W. Main St. Ext., Leetonia, OH (US) 44431

( * ) Notice: Subject to any disclaimer, the term of this patent is extended or adjusted under 35 U.S.C. 154(b) by 384 days.

(21) Appl. No.: 10/436,529

(22) Filed: May 14, 2003

(51) Int. Cl.
*A63F 1/00* (2006.01)

(52) U.S. Cl. ..... 273/292; 273/274; 273/309

(58) Field of Classification Search ..... 273/292, 273/274, 309
See application file for complete search history.

(56) References Cited

U.S. PATENT DOCUMENTS

| | | | | |
|---|---|---|---|---|
| 4,651,997 | A * | 3/1987 | Wood | 273/274 |
| 5,294,128 | A * | 3/1994 | Marquez | 273/292 |
| 5,415,414 | A * | 5/1995 | Savage | 273/306 |
| 5,865,437 | A * | 2/1999 | Moore, Jr. | 273/292 |
| 5,868,392 | A * | 2/1999 | Kraft | 273/292 |
| 5,928,081 | A * | 7/1999 | Bochichio et al. | 463/13 |
| 5,951,011 | A * | 9/1999 | Potter et al. | 273/292 |
| 6,007,424 | A * | 12/1999 | Evers et al. | 463/13 |
| 6,027,118 | A * | 2/2000 | Aramapakul et al. | 273/274 |
| 6,098,984 | A * | 8/2000 | Moore, Jr. | 273/292 |
| 6,102,403 | A * | 8/2000 | Kaufman | 273/292 |
| 6,135,453 | A * | 10/2000 | Srichayaporn | 273/292 |
| 6,189,888 | B1 * | 2/2001 | Brunelle | 273/292 |
| 6,273,424 | B1 * | 8/2001 | Breeding | 273/292 |
| 6,325,375 | B1 * | 12/2001 | Potter et al. | 273/292 |
| 6,371,484 | B1 * | 4/2002 | Yuan | 273/292 |
| 6,406,020 | B1 * | 6/2002 | Reed | 273/274 |
| 6,406,024 | B1 * | 6/2002 | Perkins | 273/292 |
| 6,443,455 | B1 * | 9/2002 | Webb | 273/274 |
| 6,446,972 | B1 * | 9/2002 | Brunelle | 273/292 |
| 6,454,266 | B1 * | 9/2002 | Breeding et al. | 273/292 |
| 6,547,246 | B1 * | 4/2003 | Webb | 273/292 |
| 6,612,580 | B1 * | 9/2003 | Weldon | 273/292 |
| 6,695,312 | B1 * | 2/2004 | Ward | 273/292 |
| 6,698,759 | B1 * | 3/2004 | Webb et al. | 273/292 |
| 6,712,360 | B1 * | 3/2004 | Yaple | 273/292 |

* cited by examiner

*Primary Examiner*—Stephen Blau
*Assistant Examiner*—Dolores R. Collins
(74) *Attorney, Agent, or Firm*—Harpman & Harpman

(57) ABSTRACT

A method for playing a casino card game which utilize a standard deck of playing cards containing numbered cards 2–10 and face cards; jack, queen, king and ace, ace being high. A playing surface is used for multiple players and a dealer. Each player position has three card receiving dock areas and corresponding wager playing areas thereon and a bonus wagering area. Three wagers are placed and a first card is dealt face down to each player. A second card is dealt to each player face up and wherein one of the equal wagers can be withdrawn by the player. Each player has their face down card turned over by the dealer and is dealt a last card face up. If the last card ranks or falls between the displayed cards in the player's hand is then a winner and a pay-off is made depending on card spread sequence. A double down doubling of wager option is also available during card play in which all wagers still remaining on the playing surface are doubled and the player receives a replacement card for the first card dealt.

3 Claims, 3 Drawing Sheets

METHOD FOR PLAYING A CASINO CARD GAME

BACKGROUND OF THE INVENTION

1. Technical Field

This method relates to casino card games that define an element of chance depending on the odds in sets of numerical symbols. Such card games rely on the player's understanding of the game, the cards being dealt and developed strategies which are based on predetermined odds of wagering to place bets associated therewith.

2. Description of Prior Art

Prior art card games utilizing the rank or value of the cards are well established within the gambling world. Various methods of playing numerically selection sequences have been developed in which card values and relative position determines a winning or loosing hand. Such games can be seen in U.S. Pat. Nos. 4,651,997, 5,294,128, 6,135,453, 6,189,888 and 6,446,972.

U.S. Pat. No. 4,651,997 is directed to a method card game in which a minimum of four standard card decks are used with a defined playing surface related to the card position and risk evaluation tables. A wager is placed and two cards are dealt face up. A second wager can then be placed and a third card is dealt face up. If the third card rank falls between the first two cards dealt then the player wins on the wagers placed determined by posted odds. Identical rank of the first two cards is an automatic winner.

U.S. Pat. No. 5,294,128 is a card game based on the traditional game of High/Low in which each player is dealt six cards divided into multiple card ranking hands of 1, 2 and 3 cards. The cards are then arranged dependent on values placed on each card based on a pre-established criteria.

U.S. Pat. No. 6,135,453 is a method of playing high/low poker card game in which players place one or more wages in pre-determined high/low areas on the gaming surface. Players are then dealt a poker hand then designating at least two cards from the hand as high and two cards as low. Winners are determined by comparing the relative rank of the player's high and low hands.

U.S. Pat. No. 6,189,888 defines a casino game in which a standard card deck is used. A better wager is made by the player divided in two and placed on the designated playing surface. Two cards are then dealt face down to each of the players of and dealer. The player inspects the cards and either keeps or trades in one or both for replacement cards and one wager is lost to the house. A third card is dealt to each player face down, but not the dealer whose third card is a count limit specialized card. The total face values of the dealt cards are determined and compared with the player's cards for determination of a winner.

Finally, in U.S. Pat. No. 6,446,972 a card game is claimed in which it is played with a standard deck of cards and a count limit card. Bets are made and two cards dealt to the players and the dealers. Players inspect the cards and can trade in one card. The dealer reveals his first two cards and a count limit card are combined for a total and compared against the player's representative cards to determine a winner with play bonus hands available.

SUMMARY OF THE INVENTION

The present invention is directed to a casino card game in which one or more players attempt to get card values between two other cards that have been dealt to him by the dealer. Three wagers of equal value are initially made, two of which can be selectively taken back by the player during the course of play. The third wager (ante) is always in play. Cards are sequentially dealt to players one at a time, the first being face down, the second face up. The dealer then returns to the first player flipping the face down card up moving sequentially around the table. There are two options during the course of play in which the first and second position wager can be withdrawn by the player. A last and deciding card is dealt to each individual between the two cards that each player has and a winning hand is determined by the rank of the last or middle card falling between the first and second card values and/or sequence of same cards dealt.

DESCRIPTION OF THE PREFERRED EMBODIMENT

Figure 1:
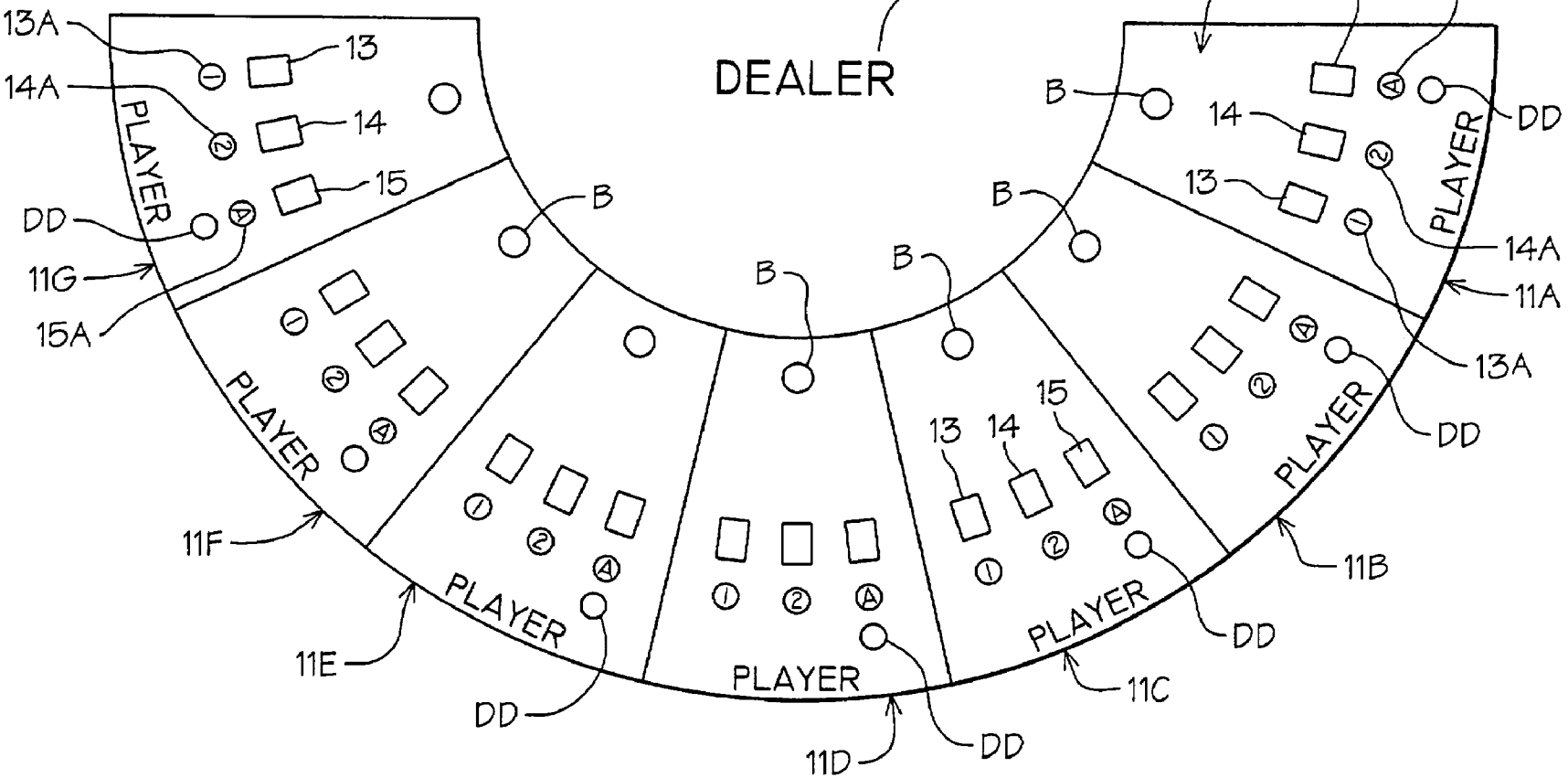
FIG. 1 is a graphic illustration of the defined playing surface for the card game of the invention.

Referring to FIG. 1 of the drawings, a wagering game of the present invention is illustrated on a simulated playing surface 10. The playing surface 10 is preferably of a pre-printed fabric material as is common in the industry and therefore will be well known to those skilled in the art. The playing surface 10 has specialized indicia imprinted thereon to designate multiple player positions 11A–11G in this example shown for illustration. The player positions 1A–11G are laid out arcuately in a half circle with the dealers position 12 indicated within. Each of the players position 11A–11G has three card receiving docks 13, 14 and 15. Below each of the above referred to card docks 13–15 is a wagering placement area circle indicia indicated at 13A (1), 14A (2), and 15A (A). The wagering circles 13A–15A are defined on the playing surface 10 with a numerical indication of 1, 2 and A respectively as noted above. The wagering circles 13A and 14A are retrievable during the course of play which will be described in greater detail hereinafter.

Wagering circle 15A (A) is defined as the "ante" and is non-retrievable throughout game play. A double down placement area circle DD in this example is positioned below the respective circle 15A (A) "ante". A jackpot "bonus" placement area circle B is positioned above the card dock 14 and represents a so-called progressive jackpot or jackpot bet option which is dependent on a specific set of card matching ranks (values) being achieved, the nature of which can be a fixed winning amount or a progressive amount that increases each time the winning match values are not achieved by the player or players.

In play, a regulation card deck is used (with a second deck being available) consisting of fifty-two playing cards in groups of varying face value as is common within the art with an ace being high. As few as one player 11A can play or as many as are available on the playing surface. In this example chosen for illustration, players positions 11A–11E are in play.

Figure 2:
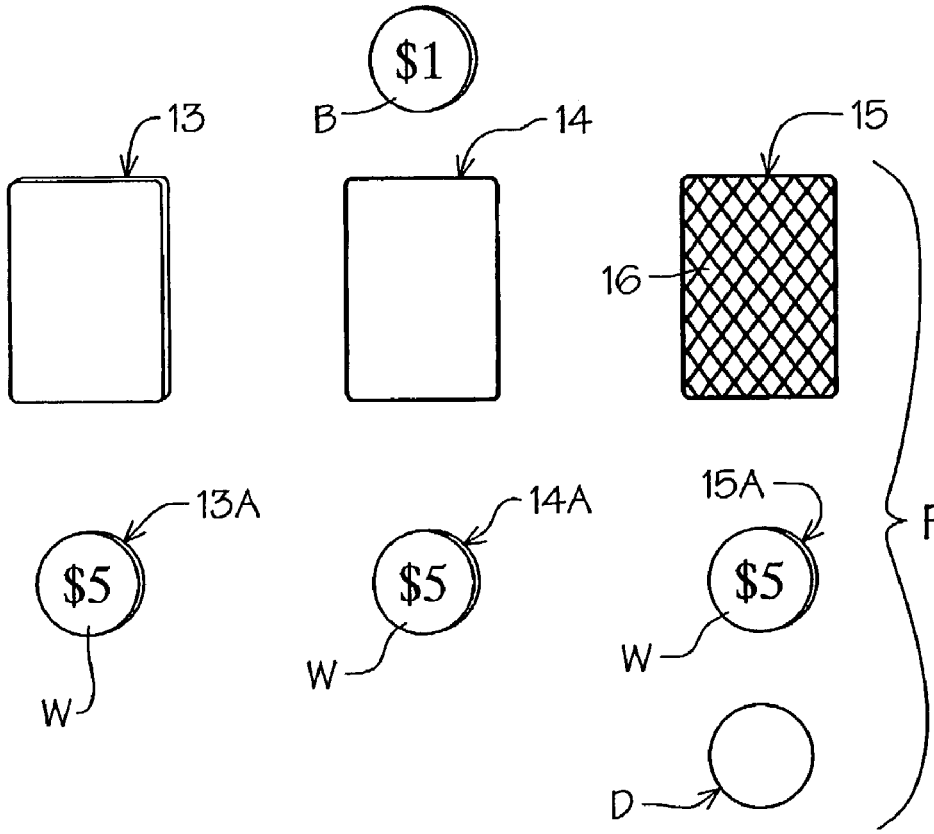
FIG. 2 is a diagramical plan view of the first card position dealt to each player and the multiple place wages on the playing surface.

The players 11A–11E place identical wagers W on each of the three hereinbefore described wagering circles 13A–15A. The dealer from the dealer position 12 deals from his left each player one card 16 face down in the first receiving dock 15 illustrated as a single position in FIG. 2 of the drawings. The dealer receives no cards during play in that each of the players 11A–11E is essentially playing in relation to the available cards in play as will be well understood by those skilled in the art.

Figure 3:
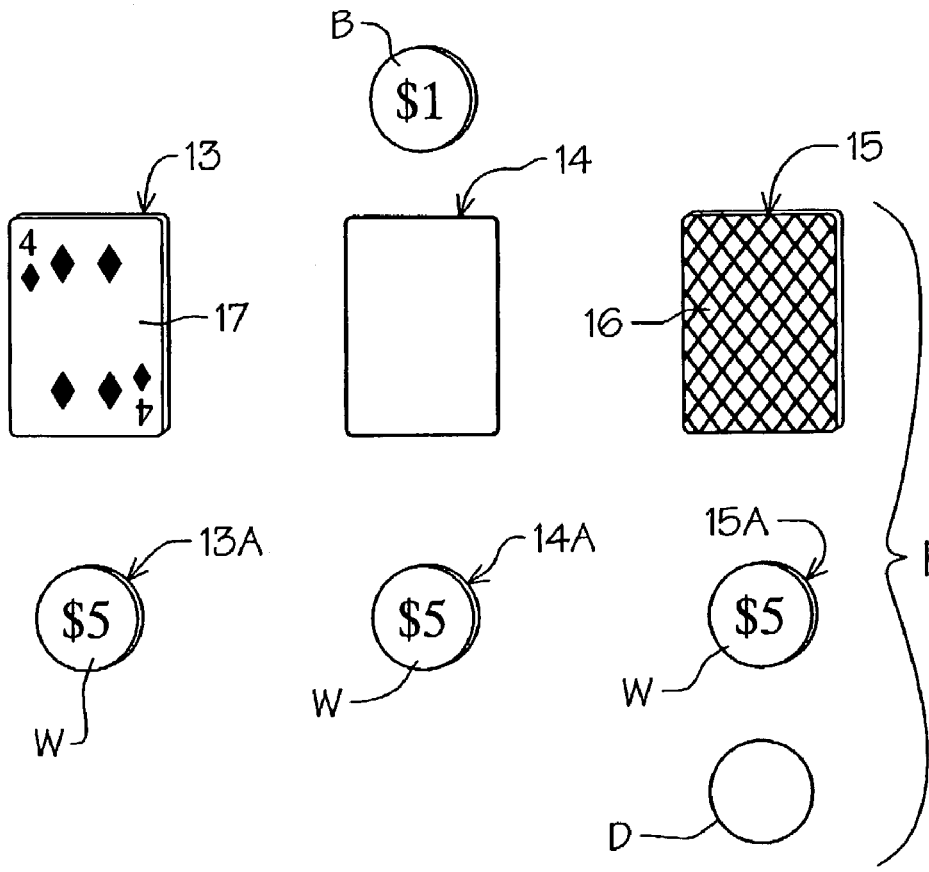
FIG. 3 is a diagramical plan view of the second card dealt position and orientation on the playing surface.

The dealer then deals each of the players 11A–11E in repeating sequence a second card 17 rank (value) face up in the card dock position 13 as illustrated in FIG. 3 of the drawings in this example as a four of diamonds.

Figure 4:
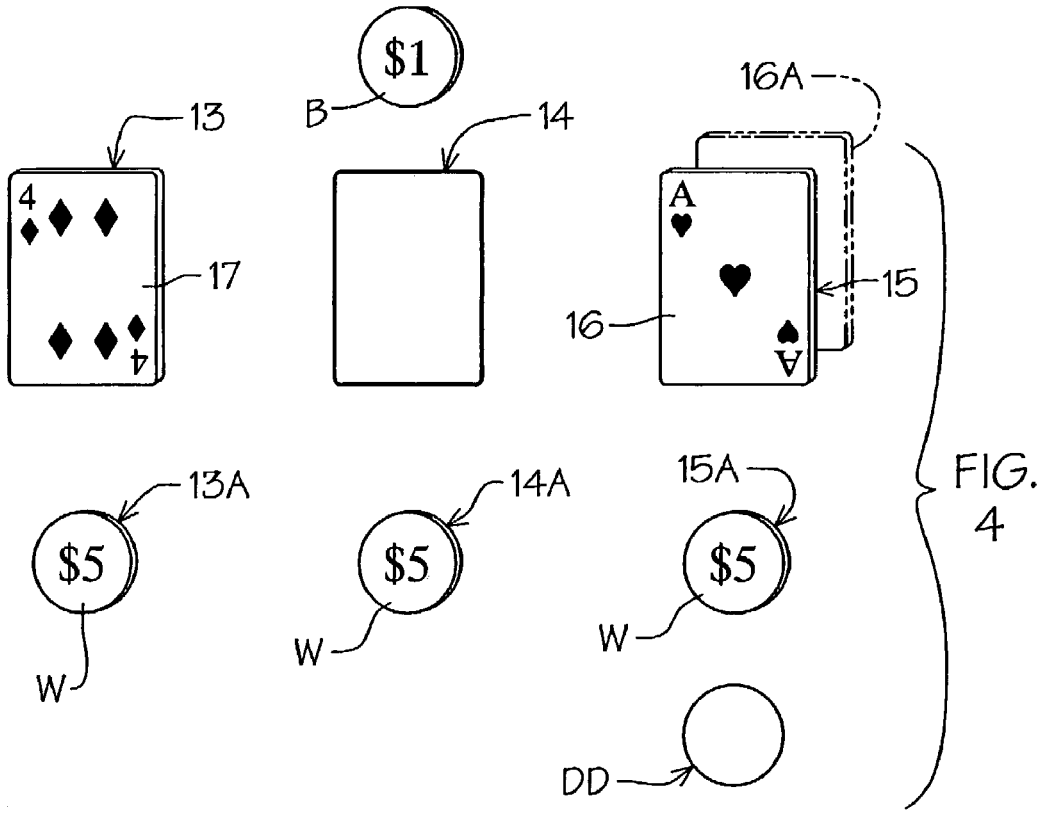
FIG. 4 is a diagramical plan view of the first and second cards face up.
Figure 5:
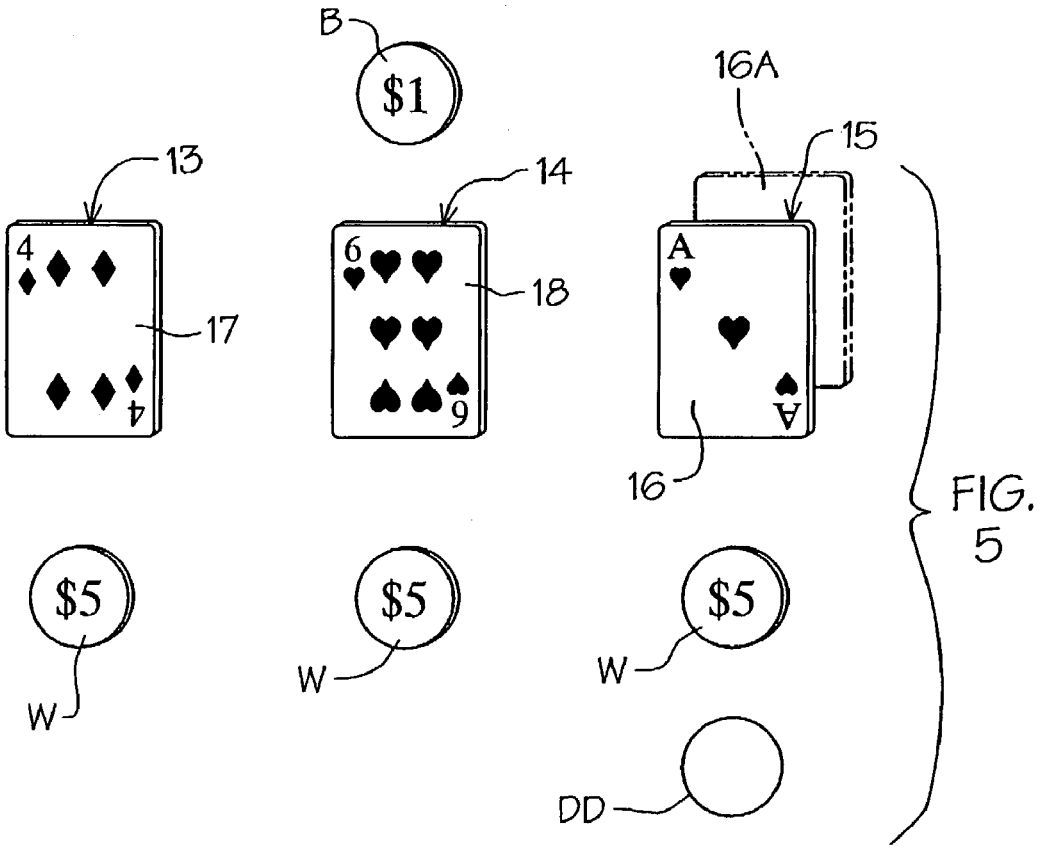
FIG. 5 is a diagramical view of a third card dealt face up between the first two cards determining a winning hand.

At this juncture in the game play, each of the players 11A–11E has the option of leaving or withdrawing their wager W from the first wage area 13A. In this example the wager W is left due to the low rank of the example card 17. The dealer then returns to the first player 11A and flips over the card 16 in the respective first card dock 15 defining the rank range between that the respective players must achieve to win. As the player can now assess the strength or weakness of their hand, the relative odds of being dealt a winning card which must fall between the respective high and low rank cards in which in this example is the ace of hearts card 16 and the four of diamonds card 17 as best illustrated in FIG. 4 of the drawings. Depending on the above referred to individual player's assessment, the player now has a second wager option to withdraw the wager W from the wagering circle 14A or a double down option indicated by the area circle DD below the card dock position 15 in which all the wagers still in play are doubled and if executed receives a replacement card 16A in card dock 15 illustrated in broken lines which will be explained in greater detail hereinafter.

In this example chosen for illustration, the effective broad range between the playing cards ace of hearts card 16 and four of diamonds card 17 visible, the wagers are maintained.

Now the dealer deals player 11A a last or final card 18 face up into the remaining card dock position 14 there between. As illustrated the card 18 in this example is a six of hearts which falls within the rank range of the player's hand and is therefore a winner, this sequence continues players 11B–11E.

In situations where the player has the card in the first position 15 once flipped and the second card position 13 are in sequence, the player can get the second position wager back and forfeits the wager W on the "ante" position 15A and the game is over for that player, if the double down option is not exercised.

The bonus area B provides for a jackpot or a progressive jackpot payment illustrated in this example as a one dollar wager is placed on the bonus area B before the start of each game. If a player receives a pair of cards of the same rank (value) and a third matching card i.e. three of a kind and has all three wagers still in play, the player wins the jackpot and the belting wagers back.

Alternately, if the player with three matching cards and a one dollar wager on the bonus position B and has only two wagers W still in play the player then wins ten percent of the predicted jackpot.

When the jackpot (bonus) is won by a single player, they receive the jackpot plus all of the wagers as outlined above. If two or more players qualify for all or part of the progressive jackpot during the same hand, the winners will share the jackpot as an aggregate.

In a situation where a player withdraws his first wager 13A then matches rank (face value) of the card such as a six of diamonds and a six of hearts and elects to pull their second wager back 14A instead of going for the jackpot or double down option, the player looses the "ante" wage 15A and will not receive another card.

The winning payout or relative odds are based on a pre-determined winning card rank spread which is determined prior to the inception of the game. For this example a one card rank spread i.e. numerical 7, 8 and 9 has a pay-out of four to one against the wagers. A two card rank spread pays out three to one. A three card rank spread pays out two to one. A four through eleven rank card spread is a one to one pay-out since presumably the odds are better to achieve a winning hand with such a large spread.

As noted, three of a kind is a winning jackpot in some conditions.

A number of options for playing can be selectively illustrated such as varying the card spread, pay-out odds and defined a fixed jackpot if so desired.

Another option available, as noted, such as raising the wagers, a so-called double down option represented by DD position on each of the player's surface as shown in FIGS. 1–5 of the drawings. This double down option is available after the card 16 is flipped over and the winning spread can be determined. The player may then at their option double all wages still in play and receive a replacement card 16A (shown in broken lines) for the original card 16 from the dealer as shown.

Other possible pay off and jackpot options are pay off options, double down bet pays even odds on double down spot money only. Option for card spread and payout may vary on spread pay-out table. Option, all bets pay even odds.

Jackpot options including jackpot base amount with (no progressive) and jackpot plays ten to one odds.

It will thus be evident from the above description that a new and novel casino type card game has been illustrated and described and it will be apparent to those skilled in the art that various changes and modifications may be made therein without departing from the spirit of the invention.

I claim:

1. A method of playing a playing card base card game utilizing a deck of standard playing cards and a playing surface defining first, second and third card and wagering placement positions for at least one player, the method comprises the steps of, a. at least one player placing three wages onto respective first, second and third wagering placement positions on the playing surface, b. a dealer dealing a first card face down into said first card placement position on the playing surface of the player, c. the dealer dealing a second card face up into a second cord placement position on the playing surface, d. the player exercising a first wager returning option for one of said place wagers on the playing surface by retrieving said wager in said first wager position, e. the dealer turning over said first card placement position to a face up on the playing surface, f. the player exercising a second wage returning option for one of said remaining placed wagers comprises retrieving said wager in said second wager position and a doubling of said ante wager and receiving a replacement card for said fast card dealt, g. the dealer dealing a third card face up into the third remaining card placement position on the playing surface, h. if said third card of step g ranks between said first and second card, said dealer paying said player an amount according to a set of predetermined odds posted on the playing surface and ending the game, i. if said third card does not rank between said first and second cards, said player looses all of said wages on said playing surface and ends the game, j. if two cards on said playing surface are in ranked sequence, player gets said wager in said second wager position on said playing surface return, k. if said cards are of the same rank a jackpot payout is achieved, said jackpot based on placement of a wager in a bonus wager placement position on said playing surface, l. said third wagering placement position defines an ante wager which is not subject to said first and second wager returning options, m. said multiple wagers are of an equal value.

2. The method of playing a card game set forth in claim 1 wherein said method step set forth in said step d of said first wager returning option comprises retrieving said wager in said first wager position.

3. The method of playing a card game set forth in claim 1 wherein said method of step "k" said cords of the same rank are two or more of a kind with three wagers still in play, said jackpot payout being progressive.

* * * * *